United States Patent [19]

Kohzu

[11] 4,166,616

[45] Sep. 4, 1979

[54] TENNIS RACKET

[75] Inventor: Minoru Kohzu, Hamamatsu, Japan

[73] Assignee: Nippon Gakki Seizo Kabushiki Kaisha, Japan

[21] Appl. No.: 798,842

[22] Filed: May 20, 1977

[30] Foreign Application Priority Data

May 25, 1976 [JP] Japan ..... 51-60475

[51] Int. Cl.[2] ..... A63B 49/02

[52] U.S. Cl. ..... 273/73 G

[58] Field of Search ..... 273/73 R, 73 C, 73 D, 273/73 F, 73 G, 73 H

[56] References Cited

U.S. PATENT DOCUMENTS

| | | | |
|---|---|---|---|
| 3,612,526 | 10/1971 | Brull | 273/73 G X |
| 3,664,669 | 5/1972 | Latham et al. | 273/73 G X |
| 3,702,701 | 11/1972 | Vaughn et al. | 273/73 G X |
| 4,045,025 | 8/1977 | Staub et al. | 273/73 G X |
| 4,046,377 | 9/1977 | Khazzam | 273/73 G |

FOREIGN PATENT DOCUMENTS

| | | | |
|---|---|---|---|
| 17228 | 7/1929 | Australia | 273/73 G |
| 667772 | 6/1929 | France | 273/73 G |
| 2205 | of 1911 | United Kingdom | 273/73 G |

*Primary Examiner*—Richard J. Apley

*Attorney, Agent, or Firm*—Ostrolenk, Faber, Gerb & Soffen

[57] ABSTRACT

In a tennis racket suited for manufacturing by molding, a throat piece or yoke is coupled to a frame with the side fringes thereof being snugly received in respective mating recesses formed in the frame in the prescribed coupling area of the two elements, thereby assuring reliable coupling of the two without the danger of accidental separation via shifting of the yoke on the frame, simplified manufacturing of the racket by molding and high resistance against impact force imposed on the strings.

7 Claims, 8 Drawing Figures

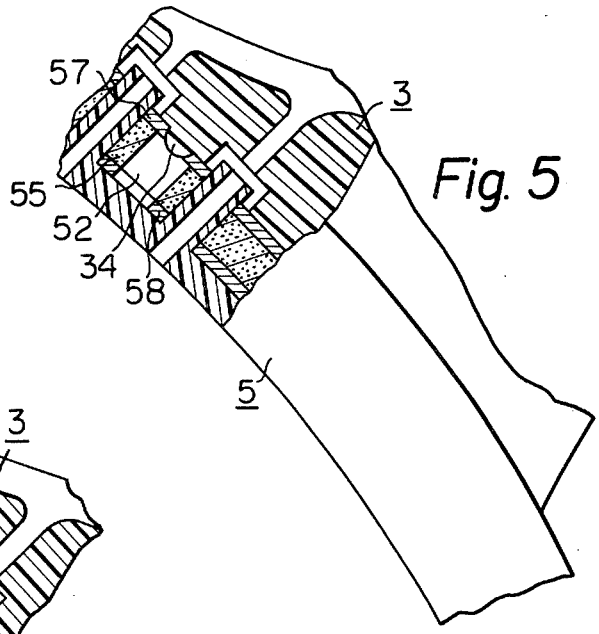
Fig. 5
Fig. 6
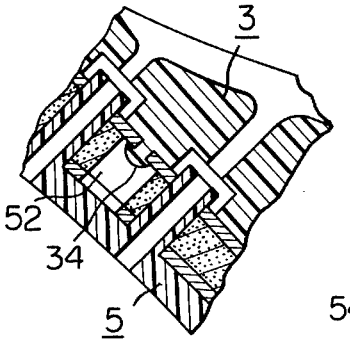
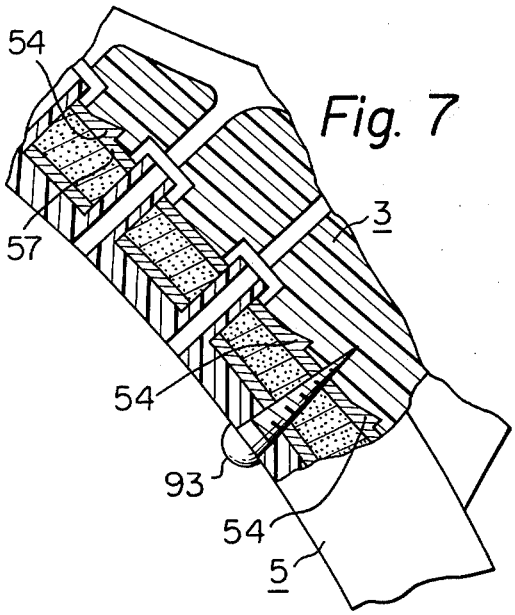
Fig. 7
Fig. 8
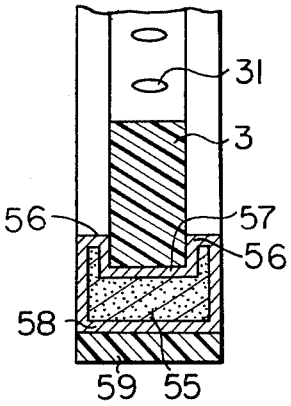

TENNIS RACKET

BACKGROUND OF THE INVENTION

The present invention relates to an improved tennis racket, and more particularly relates to an improved coupling construction of a yoke with a frame of a tennis racket suited for manufacturing by molding.

Conventional examples of the tennis racket are found in the inventions disclosed in the U.S. Pat. Nos. 3,702,701 and 3,958,805, in which the tennis racket is in general comprised of an extruded metal or molded plastic frame defining a stringing area or face and a molded plastic throat piece or yoke coupled to the frame at the shoulders of the latter.

In the following description, the sides of the elements closer to the stringing area or face will be referred to as "the inner side" whereas the opposite side of the elements will be referred to as "the outer side".

The general shape of the throat piece or yoke includes slightly concave outer side surfaces which conform in curvature to and contact the inner side surfaces of the shoulders of the frame, a concave surface defining a part of the stringing area or face of the racket and a semi-circular surface opening in the direction of the handle. The throat piece or yoke of this shape is formed separate from the frame and coupled to the shoulders of the frame by suitable fastening means such as fastening screws or adhesives. Thus, the coupling planes of the yoke is in line with the curvature of the inner side surface of the frame.

The strings are set to the frame and the yoke in a highly stretched state and the magnitude of the string tension imposed on the yoke amounts to 500 kg. or larger. Due to the above-described shape of the yoke, the converging ends of the yoke tend to shift on the shoulders of the frame in the direction of the string tension acting thereon during long use of the tennis racket, thereby causing separation of the yoke from the frame. In addition, the converging ends of the yoke tend to buckle due to the large magnitude of force applied thereto and the relatively small thickness of the portions, thereby causing early breakout of the yoke. Further, the impact force imposed on the yoke via the strings generated by hitting balls must be borne by the fastening screws or adhesives only. This stress concentration takes the form of shearing stress which causes accelerated wearing-out of the fastening screws or peeling-off of the adhesive.

SUMMARY OF THE INVENTION

It is the primary object of the present invention to provide a tennis racket affording long lasting reliable coupling of the yoke with the frame.

It is another object of the present invention to provide a tennis racket suited for simplified manufacturing by molding.

It is the other object of the present invention to provide a tennis racket excellently durable against repeated impact load on the strings.

In accordance with the present invention, elongated mating recesses are formed in the inner side surface of the frame shoulder in the coupling areas thereof and the outer side fringes of the throat piece or yoke are snugly received in the respective recesses. Preferably the mating recesses are provided with flat bottom surfaces and the fringes are provided with flat outer side mating surfaces.

BRIEF DESCRIPTION OF DRAWINGS

FIG. 8 is a section taken along the line VIII—VIII in FIG. 3.

DESCRIPTION OF THE PREFERRED EMBODIMENTS

Figure 1:
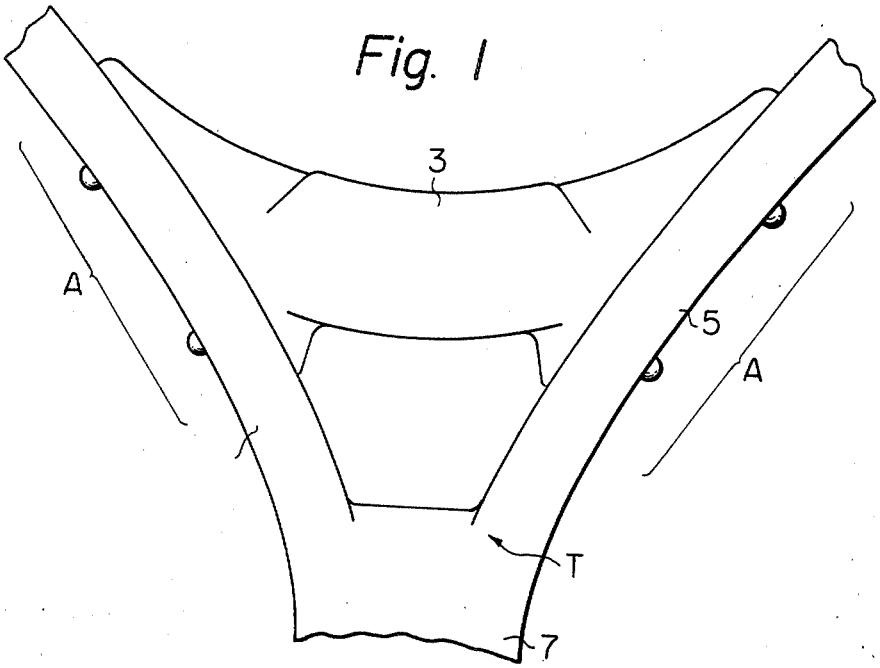
FIG. 1 is a top view of the coupling areas of a tennis racket to which the present invention is applied.

FIG. 1 generally depicts the throat T and its related parts of a tennis racket of popular style and the construction which incorporates the present invention as a component thereof. In accordance with the present invention, a throat piece or a yoke 3 is securely coupled to two shoulders of a frame 5 in two prescribed coupling areas A which are located substantially symmetrically to each other about the extension of the axial line of the shaft portion 7 of the racket. Each of the coupling areas A starts from a location near the throat T and extends over an appreciable distance towards the head portion (not shown) of the frame 5.

Figure 2:
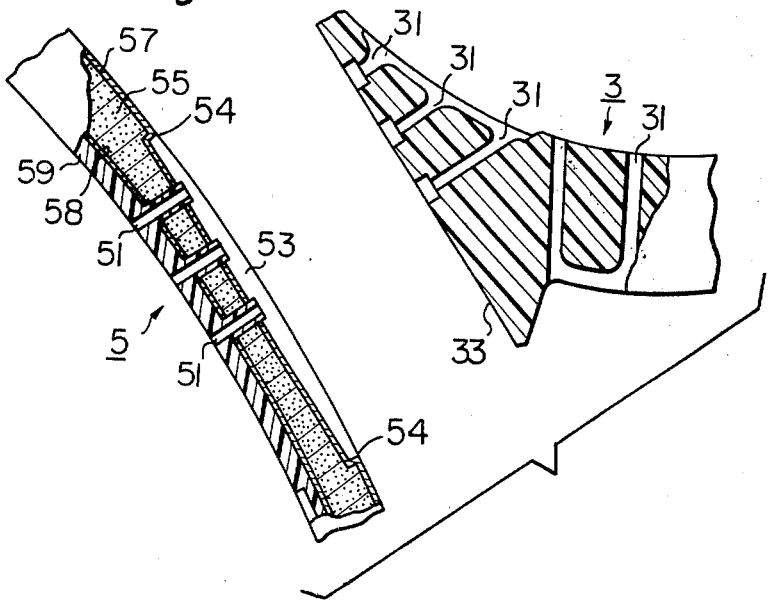
FIG. 2 is a partly sectional fragmentary top view of one embodiment of the tennis racket of the present invention in a uncoupled state.

The construction of the yoke 3 and the frame 5 in one coupling area A in accordance with one embodiment of the present invention is shown in detail in FIG. 2, in which the yoke 3 and the frame 5 are shown in an uncoupled state for better understanding of the invention.

Like the conventional one, the yoke 3 is provided with a plurality of through holes 31 extending from the inner side towards the outer side thereof and providing passages for strings which are to be held under tension by the frame 5 in the stringing area. The outer side of the yoke 3 is provided with a flat mating surface 33 adapted for the later described neat coupling with the frame 5.

The frame 5 is provided on the inner side thereof with an elongated mating recess 53 having a flat bottom surface, which extends along the inside curve of the frame 5 over the entire mating area A. The recess 53 terminates at shoulders 54 at the longitudinal ends of the recess, which are spaced to match the length of the surface 33 of yoke 3 (see FIGS. 2 and 3). A plurality of through holes 51 extend from the outer side of the frame 5 and open in the bottom surface of the elongated recess 53 through a foamed resin core 55 and surface layers 57, 58 and 59 sandwiching the foamed resin core 55. The holes 51 serve as passages for the strings.

Figure 3:
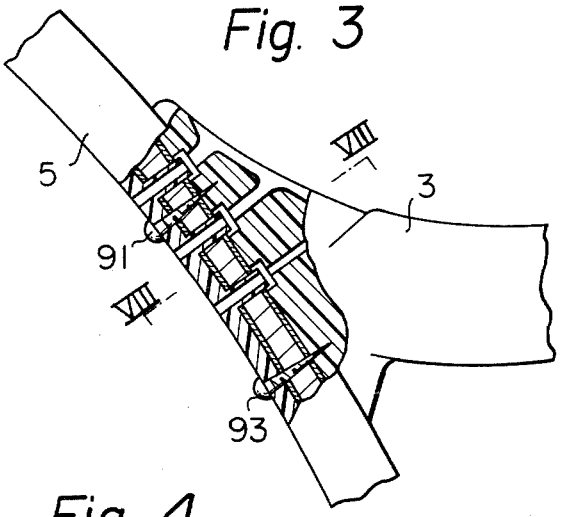
FIG. 3 is a partly sectional fragmentary top view of the same tennis racket in the coupled state.

The coupled state of the yoke 3 with the frame 5 is depicted in FIG. 3, in which the outer fringe portion of the yoke 3 is snugly received in the mating recess 53 of the frame 5 with the flat mating surface 33 of the yoke 3 being in neat over all contact with the flat bottom surface of the recess 53 in the frame 5. From the outer side of the frame 5 two fastening screws 91 and 93 are screwed into the yoke 3 across the frame 5 in order to fasten the coupling between the yoke 3 and the frame 5.

With the above-described construction, the outer fringe portions of the yoke 3 are firmly upheld in the respective mating recesses formed in the frame 5. This coupling construction effectively prevents undesirable shifting of the yoke 3 on the frame 5 which is conventionally caused by strings tension imposed on the yoke 3. Once the locations of the mating recesses 53 in the frame 5 are correctly fixed, the yoke 3 can be very easily registered at the precisely correct position on the frame 5. Flatness of the mating surfaces 33 of the yoke 3 and the bottom surface of the mating recesses 53 of the frame 5 renders manufacturing of the yoke 3 and the frame by molding very simplified, enhances accuracy in manufacturing of these tennis racket elements and assures remarkably neat coupling of the two elements. Further, change in the coupling construction of the two elements in accordance with the present invention excellently survives the beautifully curved coupling margin possessed by the tennis rackets of the conventional type. It should be further noted with the present invention that the impact force generated by hitting balls and imposed on the yoke 3 via the strings can be borne not only by the fastening screws 91 and 93 but by a great deal by the frame 5 itself. The side walls 56 defining the mating recesses 53 in the frame 5 are in neat contact with the associated fringe surfaces of the yoke 3 to bear the impact force imposed on the yoke 3 and minimize shearing force acting on the fastening screws 91 and 93, thereby remarkably decelerating quick breakout of the fastening screws 91 and 93. (see FIG. 8)

Figure 4:
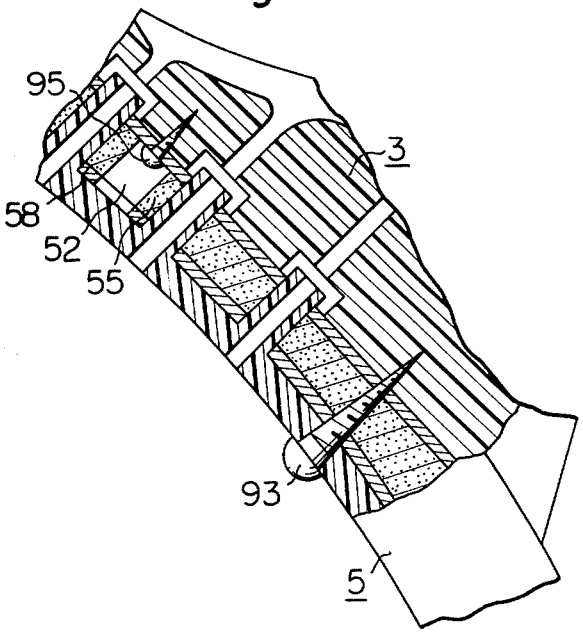
FIG. 4 is a partly sectional fragmentary top view of a variant of the tennis racket shown in FIG. 3, FIGS. 5 through 7 are partly sectional fragmentary top view of various modifications of the tennis racket shown in FIG. 3.

A variant of the embodiment shown in FIG. 3 is depicted in FIG. 4, in which a hole 52 is formed through the foamed resin core 55 and the outer surface layer 58 and a relatively small fastening screw 95 is screwed from the hole side into the yoke 3 through the inner surface layer 57. The concealed arrangement of the head of the fastening screws 95 within the body of the frame 5 greatly enhances the streamlined smoothness on the outer side surface of the frame 5. Thanks to the above-described consolidated holding construction of the yoke 3 by the frame 5 itself, use of such small fastening screws 95 never weaken the coupling of the yoke 3 with the frame 5.

In accordance with another aspect of the present invention, it is also possible to omit one of the pair of fastening screwes 91 and 93 used in the embodiment shown in FIGS. 3 and 4.

A modified embodiment of the present invention shown in FIG. 5 excludes the fastening screw close to the converging end of the yoke 3. As a substitute, a hole is formed through the inner surface layer 57 of the frame 5 which opens in a larger hole 52 formed through the foamed resin core 55 and the outer surface layer 58 as is the case with the construction shown in FIG. 4 and the mating surface of the yoke 3 has a projection 34 snugly received in the hole of the inner surface layer 57 and partly extending into the hole 52 in the foamed resin core 55.

A variant of this embodiment is shown in FIG. 6, in which the portion of the projection 34 extending into the hole 52 in the foamed resin core 55 is flattened in order to further fortify the coupling of the yoke 3 with the frame 5.

A further modification of the present invention excluding one of the fastening screws is depicted in FIG. 7. The yoke 3 of this embodiment is provided with wedge shaped hollows formed in the mating surface thereof and the frame 5 is provided with corresponding number of wedge shaped projections 54 formed on the inner surface of the inner surface layer 57 which are snugly received in the associated hollows of the yoke 3.

In connection with the embodiments shown in FIG. 5 through 7, it should be noted that the coupling construction depending on the projection-hole or projection-hollow combination excellently resists against the undersirable shifting of the yoke 3 on the frame 5.

What is claimed is:

1. An improved tennis racket, comprising:

a frame shaped to have an inner side and having two coupling areas on said inner side, with said coupling areas generally facing toward each other and being located substantially symmetrically about the axial line of said racket;

each said coupling area on said inner side comprising the surface of said frame on said inner side having a recess defined therein, and each said recess extending longitudinally along said frame inner side; spaced apart shoulders on said frame inner side defining the longitudinal ends each of said recess along said frame; said frame inner side having upstanding opposed side walls along the lateral sides of each said recess and said side walls defining each said recess between them, whereby each said recess is defined and its length and width dimensions are determined by said shoulders and said side walls;

a yoke having outer fringes defined along generally opposite sides thereof; each said fringe being received in a respective recess; each said fringe being shaped and dimensioned such that said fringe contacts both said shoulders and both said side walls of said recess, whereby each said fringe is snugly received in the respective said recess;

means for fastening said yoke to said frame;

each of said mating recesses being provided with a flat, uncurved bottom surface and each of said fringes of said yoke is provided with a flat uncurved surface which contacts the respective said recess bottom surface.

2. An improved tennis racket as claimed in claim 1 in which said fastening means includes fastening screws screwed from the outer side of said frame into said fringes of said yoke.

3. An improved tennis racket as claimed in claim 2 in which, in each of said coupling areas, one of said fastening screws is fully concealed in the body of said frame.

4. An improved tennis racket as claimed in claim 1 in which said fastening means includes at least one projection formed on the outer side of each of said fringes of said yoke and extending into the body of said frame.

5. An improved tennis racket as claimed in claim 5 in which the portion of said projection extending into said body of said frame is flattened.

6. An improved tennis racket as claimed in claim 1 in which said fastening means includes a plurality of wedge shaped hollows formed in the outer sides of said fringes of said yoke and corresponding number of wedge shaped projections formed on the inner side surface of said frame and adapted for being snugly received in said respective hollows.

7. An improved tennis racket, comprising:

a frame shaped to have an inner side and have two coupling areas on said inner side, with said coupling areas generally facing toward each other and being located substantially symmetrically about the axial line of said racket;

each said coupling area on said inner side comprising the surface of said frame on said inner side having a recess defined therein, and each said recess extending longitudinally along said frame inner side and being provided with a flat, uncurved bottom surface; spaced apart shoulders on said frame inner side defining the longitudinal ends of each said recess along said frame; said frame inner side having upstanding opposite side walls along the lateral sides of each said recess and said side walls defining each said recess between them; whereby each said recess is defined and its length and width dimensions are determined by said shoulders and said side walls;

a yoke having outer fringes along generally opposite sides thereof; each said fringe being provided with a flat, uncurved surface which contacts said recess bottom surface, each said fringe being shaped and dimensioned such that said fringe contacts both said shoulders and both said side walls of said recess, whereby each said fringe is received in the respective said recess; and means for fastening said yoke to said frame.

* * * * *